US005259226A

United States Patent [19]

Itaya

[11] Patent Number: 5,259,226

[45] Date of Patent: Nov. 9, 1993

[54] MECHANISM FOR FORMING SPRING PITCH

[75] Inventor: Ichiro Itaya, Tokyo, Japan

[73] Assignee: Kabushiki Kaisha Itaya Seisaku Sho, Japan

[21] Appl. No.: 29,031

[22] Filed: Mar. 10, 1993

[30] Foreign Application Priority Data

Jul. 24, 1992 [JP] Japan ..... 4-198193

[51] Int. Cl.[5] ..... B21F 3/02

[52] U.S. Cl. ..... 72/138; 72/140; 72/442; 72/452

[58] Field of Search ..... 72/135, 138, 140, 143, 72/144, 145, 442, 452, 142

[56] References Cited

U.S. PATENT DOCUMENTS

| | | | |
|---|---|---|---|
| 3,427,838 | 2/1969 | Rimmer | 72/138 |
| 3,456,470 | 7/1969 | Dawes | 72/135 |
| 3,934,445 | 1/1976 | Lampietti | 72/138 |
| 4,173,135 | 11/1979 | Lamperti | 72/138 |
| 4,302,959 | 12/1981 | Yakovlev et al. | 72/143 |
| 4,393,678 | 7/1983 | Favot et al. | 72/138 |
| 4,873,854 | 10/1989 | Russell et al. | 72/138 |

FOREIGN PATENT DOCUMENTS

| | | | |
|---|---|---|---|
| 2063123 | 6/1981 | United Kingdom | 72/135 |

*Primary Examiner*—Lowell A. Larson
*Assistant Examiner*—Michael J. McKeon
*Attorney, Agent, or Firm*—Merchant, Gould, Smith, Edell, Welter & Schmidt

[57] ABSTRACT

A spring manufacturing apparatus has a first mode in which a spring pitch is formed by inserting a wedge tool between coils of a wire material forcibly bent by a point tool, and a second mode in which the spring pitch is formed by pushing the bent wire material in a lateral direction. The first and second modes share the same driving source. The direction in which the wedge tool moves in the first mode and that in which the wire material is pushed in the second mode are substantially at right angles to each other, and therefore driving force in the first mode can be used also in the second mode by mounting on the apparatus a member that converts the direction of motion.

4 Claims, 5 Drawing Sheets

MECHANISM FOR FORMING SPRING PITCH

BACKGROUND OF THE INVENTION

This invention relates to a mechanism for forming spring pitch and, more particularly, to a spring-pitch forming mechanism in which a spring of the type that expands and contracts in the axial direction thereof is formed to have a desired pitch.

A mechanism for bending wire material in a spring manufacturing apparatus generally is of two types. One is a mechanism in which the wire material is wound upon a winding shaft moved in the axial direction while being rotated, and the other is a mechanism in which the wire material is supplied to a prescribed point tool and forcibly bent by the tool.

The former is suitable for the manufacture of a torsion spring (mainly a spring whose two ends have straight legs), and the latter is suitable for the manufacture of springs that contract or expand.

In the latter mechanism wherein the wire material is supplied to the point tool and forcibly bent, there are two means available for providing a spring with pitch while it is being manufactured. The wire material bent by the point tool is formed into a helical shape having a prescribed diameter in dependence upon the position and orientation of the point tool, but each coil of the wire material is in intimate contact with its neighboring coils.

One of the means for providing pitch mentioned above is to forcibly insert a sharp member between the coils of the wire material while the coils are being produced. This shall be referred to as the "wedge method" hereinafter. The insertion of the member is performed a single time in synchronism with the manufacture of a single spring.

In the other means for providing pitch, the wire material, immediately after it has been bent by the point tool, is forced out in a direction perpendicular to the plane in which the wire material is bent. This shall be referred to as the "pushing method" hereinafter. The pushing of the wire material is performed one time in synchronism with the manufacture of a single spring.

Accordingly, a user who manufactures springs with the wedge method is provided with a spring manufacturing apparatus that relies upon the wedge method, and a user who manufactures springs with the pushing method is provided with a spring manufacturing apparatus that relies upon the pushing method.

Recently, a single spring manufacturing apparatus capable of manufacturing springs using both of these pitch forming methods has been developed and several types of such apparatus have appeared. However, though these apparatus seem to enable manufacture in which the wedge and pushing methods are combined, the driving sources for driving these systems are independent of each other, as a result of which an increase in the size and cost of the apparatus cannot be avoided. Moreover, since the driving sources that make possible operation in the wedge and pushing methods are situated within the inner reaches of the apparatus, the mechanisms that transmit the driving forces from these sources to the spring manufacturing area inevitably are of a complicated nature. Complicated machinery makes it difficult to manufacture highly precise springs. The reason for this is that when a large number of mechanical parts intervene between the driving sources and the spring manufacturing area, overall play or backlash is amplified to a significant degree even if play or backlash of the individual parts is negligible.

SUMMARY OF THE INVENTION

Accordingly, an object of the present invention is to provide a spring pitch forming mechanism which, through a simple structure, makes it possible to apply a pitch to a spring in a highly accurate manner by either the wedge or pushing method utilizing only a single driving source.

According to the present invention, the foregoing object is attained by providing a spring pitch forming mechanism in a spring manufacturing apparatus having a first mode and a second mode for supplying a wire material toward a point tool in the proximity of a spring forming area and bringing the wire material into contact with the point tool to forcibly bend the wire material so as to produce a spring diameter and apply a pitch to the wire material, wherein the first mode produces a pitch between loops of the bent wire material by forcibly inserting a wedge tool, which has a sharp blade, into the bent wire material, and the second mode produces a pitch by pushing the bent wire material using a pushing tool that moves at right angles to both a direction in which the wedge tool is inserted and a direction in which the wire material is supplied, the mechanism comprising:

a cam turned by a motor;

a first slider portion, one end of which is in abutting contact with a side face of the cam, for moving in a direction the same as the insertion direction of the wedge tool, the wedge tool being freely detachably mounted on the first slider portion;

a second slider portion, on which the pushing tool is mounted, for sliding in the direction in which the pushing tool moves; and a moving-direction converting member, which is freely detachably mounted on the first slider portion, for transmitting motion of the first slider portion to the second slider portion;

wherein in a case where a spring pitch is produced in the first mode, the moving-direction converting member is detached from the first slider portion and the wedge tool is mounted on the first slider portion; and in a case where a spring pitch is produced in the second mode, the moving-direction converting member is mounted on the first slider portion and the wedge tool is detached from the first slider portion.

In another aspect of the invention, the foregoing object is attained by providing a spring pitch forming mechanism in an apparatus for manufacturing a spring by supplying a wire material toward a point tool in the proximity of a spring forming area and bringing the wire material into contact with the point tool to forcibly bend the wire material so as to produce a spring diameter, comprising:

a cam turned by a motor;

a first slider portion in abutting contact with a side face of the cam for moving in a direction substantially perpendicular to a direction in which the wire material is supplied;

a second slider portion mounting a pushing member having a distal end situated in the proximity of the spring forming area for pushing the wire material bent by the point tool in a direction substantially perpendicular to a bending plane of the wire material, the second slider portion having a prescribed projection on a side face thereof and being freely movable in the direction substantially perpendicular to the bending plane;

an inclined member freely detachably mounted on the first slider portion and having an inclined contact surface for coming into abutting contact with the projection of the second slider portion; and a wedge member freely detachably mounted on the first slider portion and having a short blade for being thrust into the wire material bent by the point tool;

wherein in a case where a spring pitch is formed by the pushing member, the inclined member is mounted on the first slider portion and the wedge member is detached from the first slider portion; and in a case where a spring pitch is formed by the wedge member, the wedge member is mounted on the first slider portion and the inclined member is detached from the first slider portion.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A spring manufacturing apparatus according to this embodiment not only makes it possible to change over between the wedge method and the pushing method but also makes it possible to realize both methods through a common driving mechanism and simple structure, thereby lowering cost and enabling the manufacture of high-precision springs.

The spring manufacturing apparatus of this embodiment will now be described in detail with reference to the drawings.

DESCRIPTION OF SPRING-PITCH FORMATION BY THE WEDGE METHOD

The formation of spring pitch by the wedge method in accordance with this embodiment will be described first.

Figure 1:
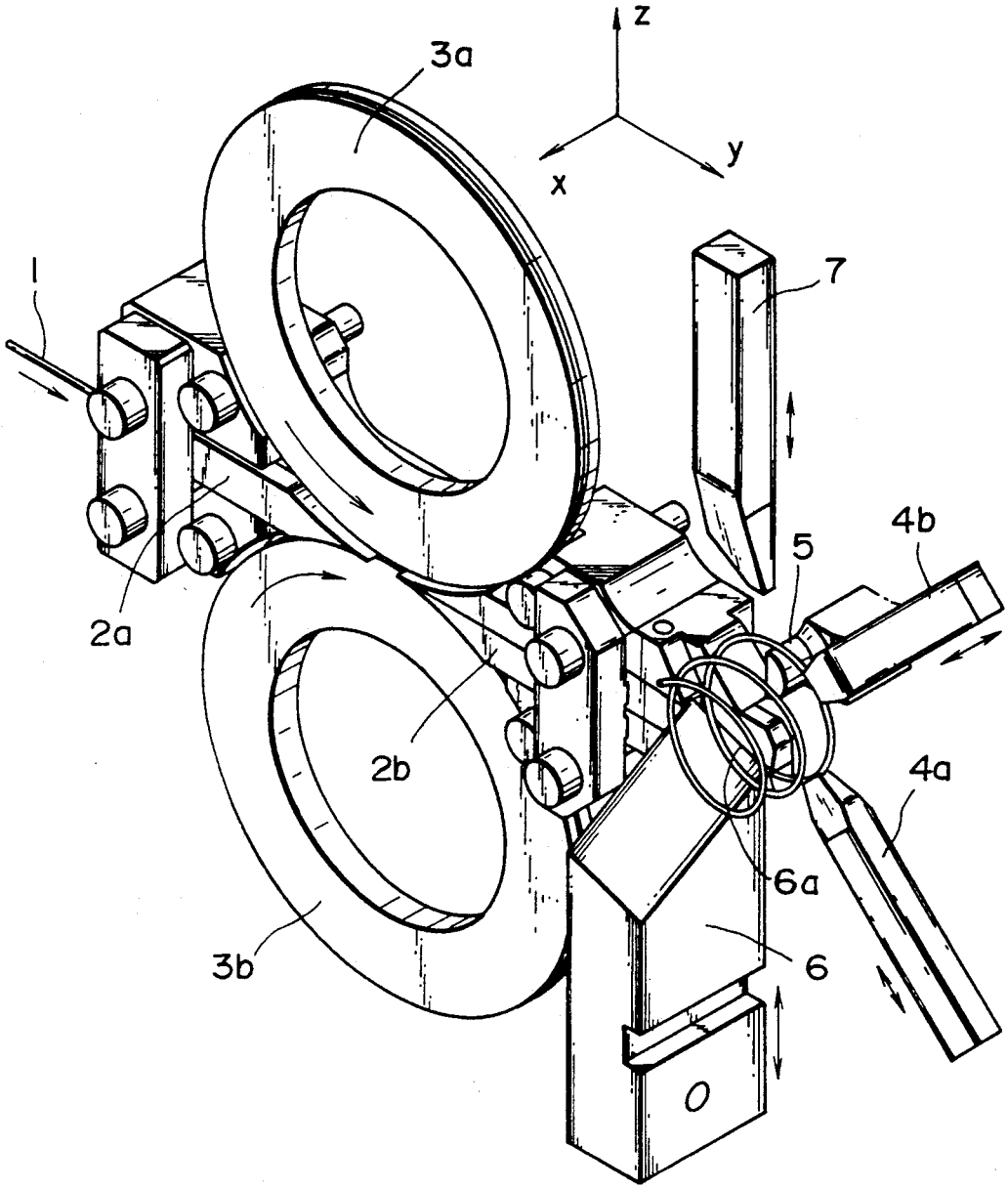
FIG. 1 is a perspective view for describing the structure and operation of a spring manufacturing section that relies upon the pushing method in an embodiment of the present invention.

FIG. 1 illustrates the structure of the principal components used in spring manufacture by the wedge method according to this embodiment. These components will be described in accordance with the operation thereof.

A wire material 1 from a source (not shown) of such material is inserted into a guide groove (not shown) provided in wire-material guides 2*a*, 2*b*. Feed rollers 3*a*, 3*b* that clamp the wire material between them are provided at a position substantially midway between guides 2*a*, 2*b*. The feed rollers 3*a*, 3*b* are rotated in the directions of the arrows in FIG. 1 by a wire-material feed motor, described later, so that the wire material 1 is conveyed in the y direction. The wire material that has emerged from the terminus of the guide 2*b* abuts against point tools 4*a* and 4*b* and is forcibly bent in a plane that is parallel to the y-z plane. At this time the wire material 1 is provided with a diameter than conforms to the positions of the point tools 4*a*, 4*b*. Though there is no direct relation to the present invention, the point tools 4*a*, 4*b* are capable of being moved in the directions of the arrows in FIG. 1 by a point-axis motor, described below. By controlling this motor, it is possible to manufacture a tapered spring, by way of example. Further, in order that the wire material bent by the point tools 4*a*, 4*b* will be bent reliably in a prescribed direction, the point tools 4*a*, 4*b* are provided with grooves in the surfaces that contact the wire material 1.

As the feed rollers 3*a*, 3*b* continue rotating under the foregoing conditions, a spring is formed in which the mutually adjacent loops of the wire material are in intimate contact. When a wedge tool 6 having a blade portion 6*a* is raised in the z direction, the blade portion 6*a* is thrust between the bent wire material and the side face of the guide 2*b* in the manner illustrated. As a result, the spring of pitch zero (actually a spring having a pitch equivalent to the thickness of the wire material) is formed into a spring having a pitch.

At an initial stage for manufacturing a single spring, the wedge tool 6 is located at a position (the "home" position) at which the blade portion 6*a* will not contact the bent wire material. The wedge tool 6 is raised (moved in the z direction) gradually during the spring manufacturing process and then is lowered (moved in the −z direction) at a final stage so as to be returned to the home position. In other words, the wedge tool 6 is moved back and forth along the z axis whenever a single spring is manufactured. How far the wedge tool 6 is raised (this decides the pitch) and how long the wedge tool 6 is maintained at this raised position (this decides the free length of the spring) depend upon the shape (inclusive of the length and diameter) of the spring that is to be manufactured.

When a single spring is thus manufactured, a cutting tool 7 is lowered (moved in the −z direction) by a cutting-axis motor, described below, so that the wire material 1 is severed between the cutting tool 7 and a mandrel 5.

DESCRIPTION OF SPRING-PITCH FORMATION BY THE PUSHING METHOD

The formation of spring pitch by the pushing method in accordance with this embodiment will be described next.

Figure 2:
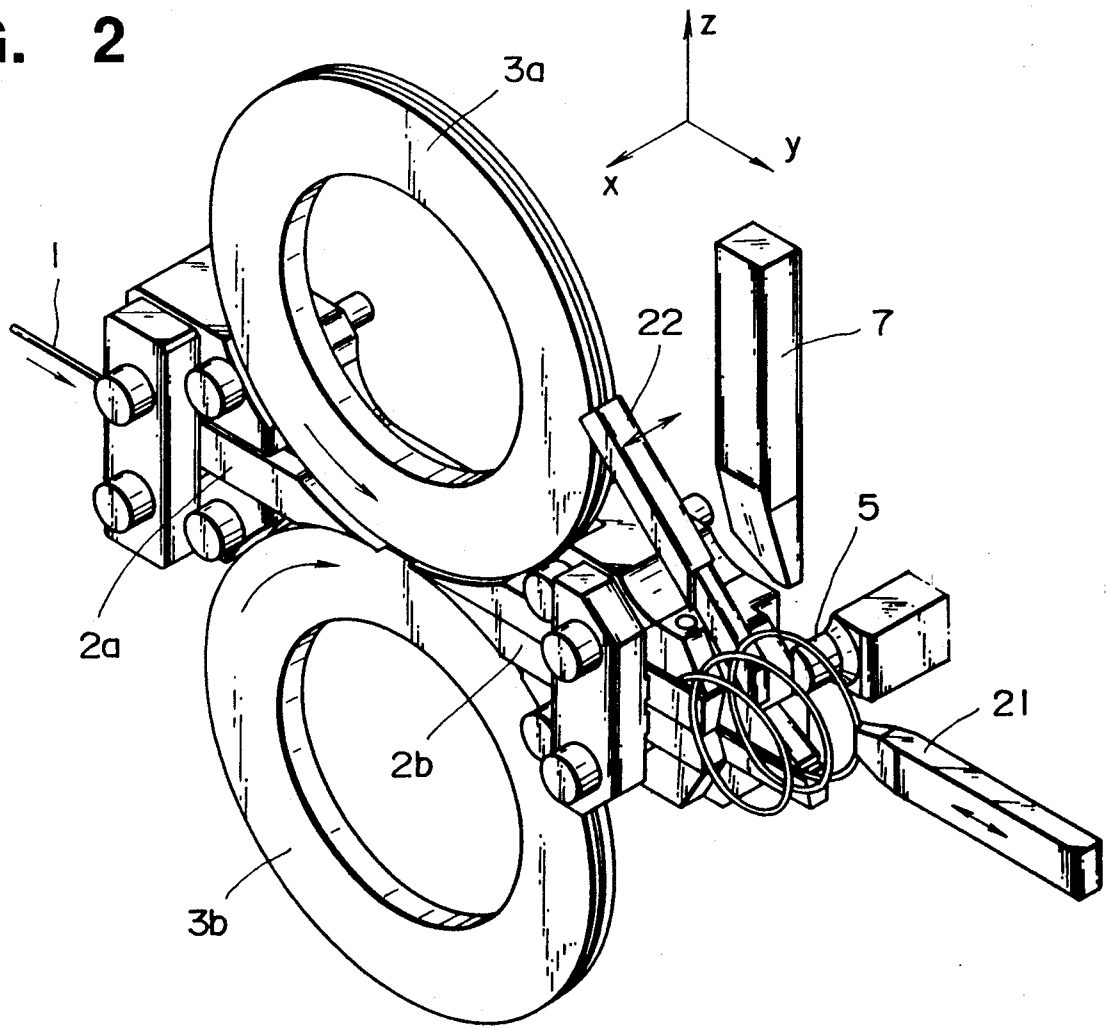
FIG. 2 is a perspective view for describing the structure and operation of a spring manufacturing section that relies upon the wedge method in an embodiment of the present invention.

FIG. 2 illustrates the structure of the principal components used in spring manufacture by the pushing method according to this embodiment. This arrangement differs from that of FIG. 1 in that a pushing tool 22 is provided instead of the wedge tool 6. It should be noted that a mounting portion for securing a point tool is provided at several positions beforehand in the actual spring forming area, as indicated by a point tool 21, in such a manner that point tools can be changed in position. The position of the point tool illustrated is shown as an example only, and the positions of the point tools in FIG. 1 as well as the number thereof may be as desired.

In the arrangement of FIG. 2, the operation through which the wire material 1 is supplied and forcibly bent by the point tool 21 is the same as described in connection with the wedge method above. The only difference is that the pushing tool 22 is moved in the directions of the arrows in FIG. 2 so that the wire material is pushed in the x direction immediately after being bent, thereby forming the pitch. Of course, the pushing tool 22 also is moved back and forth along the x axis whenever a single spring is manufactured.

In a case where spring pitch is formed by the wedge method, it goes without saying that the pushing tool 22 is detached and the wedge tool 6 is mounted instead.

DESCRIPTION OF PITCH FORMING AREA

In pitch formation according to this embodiment, as described above, spring pitch can be formed by movement of the wedge 6 along the z axis or movement of the pushing tool 22 along the x axis. It is noteworthy that a single common driving mechanism is employed for both types of movement in this embodiment, and that the mechanism is realized by a very simple structure.

Figure 3:
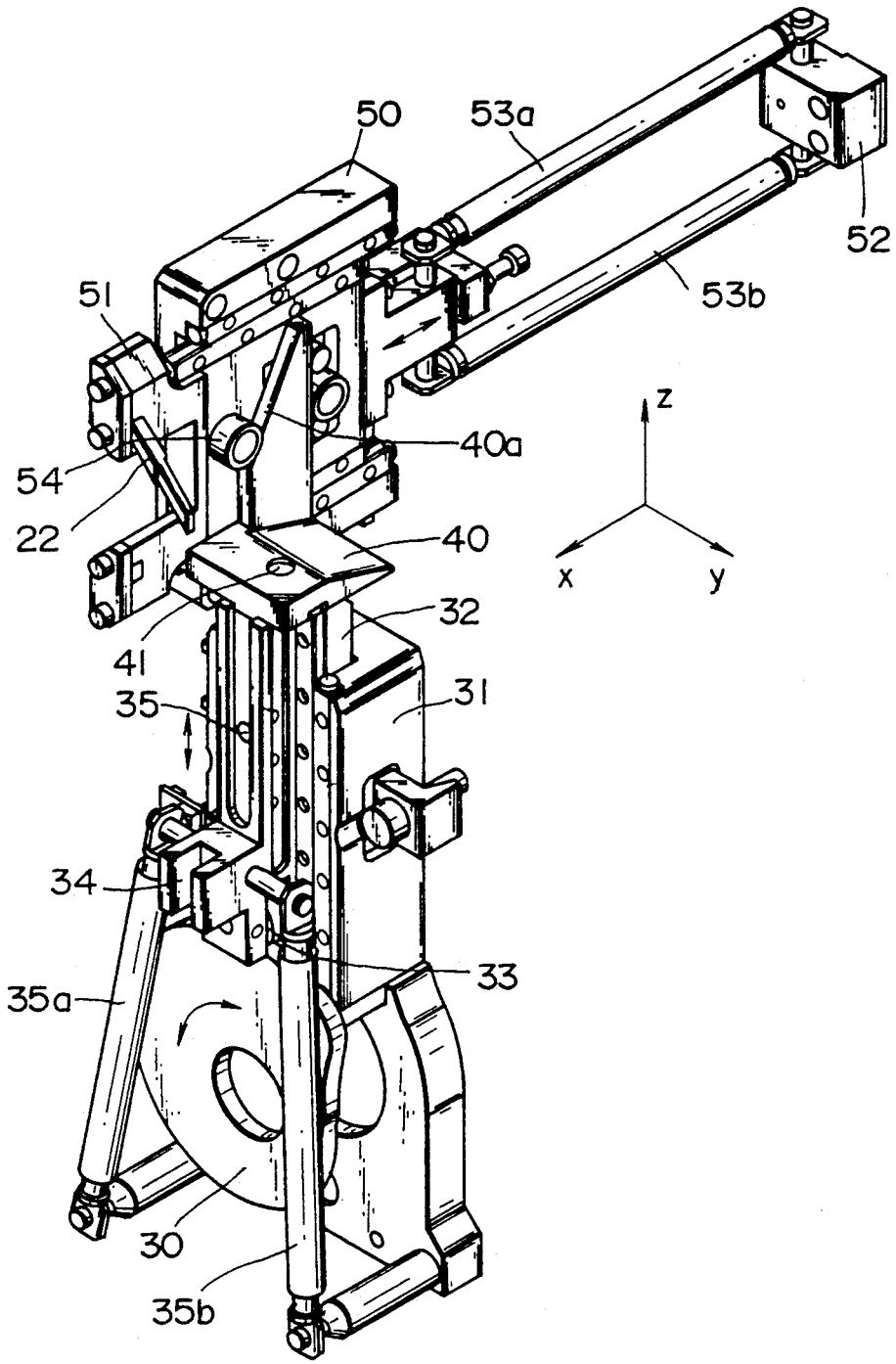
FIG. 3 is a perspective view showing the structure of a spring pitch forming mechanism, particularly when the pushing method is employed, according to the embodiment of the invention.

FIG. 3 illustrates the driving mechanism for a case where spring pitch is formed by the pushing method. Operation in connection with FIG. 3 will now be described.

A slider portion 32 is mounted on a slide base 31 so as to be freely slidable along the z axis. A freely rotatable cam follower 33 is attached to the lower end of the slider portion 32, and the cam follower 33 is in abutting contact with the side face of a cam 30 attached to the lower portion of the slide base 31. In order to arrange it so that the slider portion 32 will be tensioned downward (along the −z axis) at all times, cam springs 35*a*, 35*b* are attached at one end to a cam-spring mounting portion 34 (formed as an integral part of the slider portion 32) and at the other end to bottom of the slide base. The arrangement is such that the cam 30 turns when driven by a pitch-axis motor, not shown.

Accordingly, when the pitch-axis motor is driven, the cam 30 turns in the directions indicated by the arrows, as a result of which the slider portion 32 is moved up and down, i.e., along the z axis.

The arrangement for moving the pushing tool 22 in the direction of the x axis will now be described.

A pushing-tool slide base 50 and a fixed member 52 are fixed in position. A pushing-tool slider portion 51 capable of sliding freely in the x direction is mounted on the pushing-tool slide base 50. The rear end of the pushing-tool slider portion 51 and the fixing member 52 are connected by springs 53*a*, 53*b* so that the pushing-tool slider portion 51 is tensioned along the −x axis at all times owing to the action of the springs 53*a*, 53*b*. The pushing tool 22 is secured to the distal end portion of the pushing-tool slider 51 by bolts.

In order to transmit the driving force produced by the cam 30 to the pushing-tool slider portion 51, an inclined member 40 having an inclined portion 40*a* is mounted by a bolt 41 at a position at the upper end of the slider portion 32. A freely rotatable cam follower 54 for coming into contact with the inclined portion 40*a* of the inclined member 40 is attached to the side face of the pushing-tool slider portion 51.

In this arrangement, the inclined member 40 attached to the slider 32 is moved along the z axis in response to driving of the pitch-axis motor, not shown. As a result, the follower 54 attached to the side face of the pushing-tool slider 51 follows the inclined portion 40*a* of the inclined member 40, and therefore the pushing-tool slider 51 moves along the x axis. In other words, the pushing tool 22 moves along the x axis.

In the structure illustrated, the pushing tool 22, cam 30 and slider 32, etc., are fully exposed externally of the spring manufacturing apparatus so that the inclined member 40 and wedge tool 6 can be readily attached and detached.

Spring manufacture described using FIG. 2 is thus carried out.

In case of spring manufacture by the wedge method of FIG. 1, first the inclined member 40 in FIG. 3 is detached from the slider portion 32 so that the driving force produce by turning of the cam 30 will not be transmitted to the pushing-tool slider 51. Further, as a result of detaching the inclined member 40, the pushing-tool slider 51 is moved in the direction of the fixed member 52 (the −x direction) by the action of the springs 53*a*, 53*b*, after which the slider 51 comes to rest at a predetermined position. Consequently, the pushing tool 22 is shunted to a position at which it will not interfere with the spring manufacturing process performed in accordance with the wedge method. It should be noted that the pushing tool 22 may have a variety of shapes and that these various pushing tools are capable of being interchanged as necessary.

With the inclined member 40 detached, the wedge tool 6 is mounted on the slider 32. Since the wedge tool 6 moves along the z axis, as illustrated in FIG. 1, the axis of movement of the slider 32 is the same.

Figure 4:
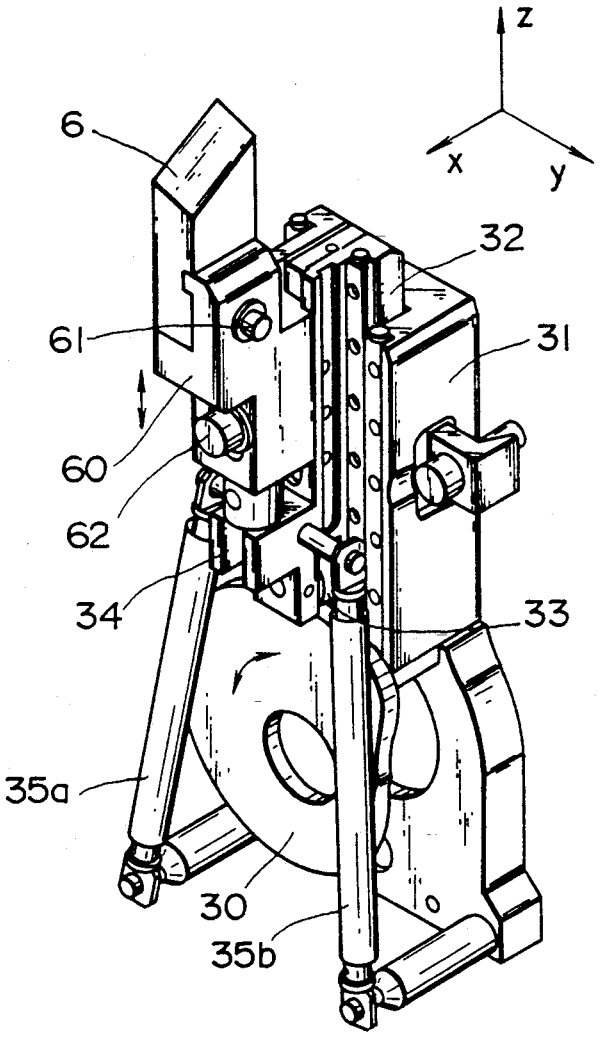
FIG. 4 is a perspective view showing the structure of the spring pitch forming mechanism, particularly when the wedge method is employed, according to the embodiment of the invention.

FIG. 4 illustrates the state in which the wedge tool 6 has been mounted on the side face of the slider 32 via a wedge-tool mount 60. The wedge tool 6 is secured to the wedge-tool mount 60 (screw hole 35) by a bolt 61, and the wedge-tool mount 60 is fixed to the slider 32 by a bolt 62. The wedge tool 6 is not mounted directly on the slider 32 in order to allow wedge tools of different shapes to be interchanged. This also means that the wedge tool itself is prevented from becoming too large in size. Actually, the state in which the wedge tool 6 has been detached from the mount 60, namely the state in which only the wedge-tool mount has been attached to the slider 32, is that which will not interfere with spring manufacture in accordance with the pushing method.

In FIG. 4, the sliding mechanism of the pushing tool 22, namely the pushing-tool slide base 50, the pushing-tool slider portion 51 and the fixed member 32, is not illustrated. This is for the purpose of simplifying the description of the wedge tool mechanism. This does not mean that this mechanism is detached when springs are manufactured by the wedge tool 6.

DESCRIPTION OF CONTROLLER

Figure 5:
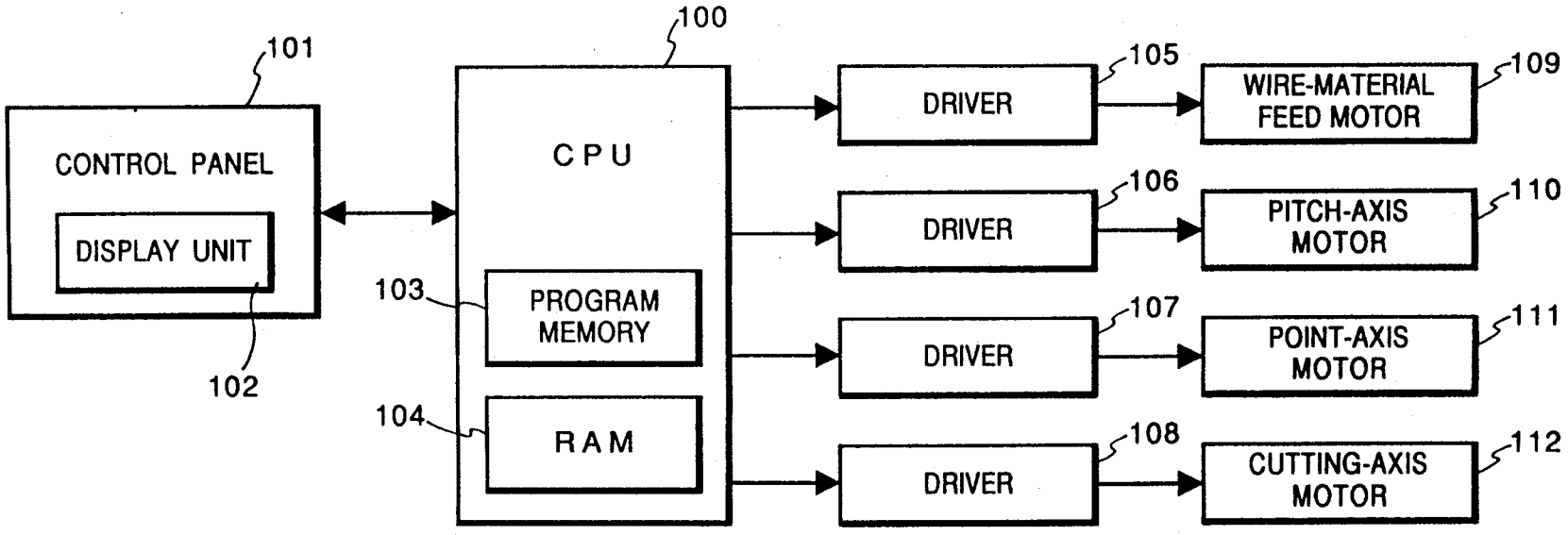
FIG. 5 is a block diagram illustrating a controller according to the embodiment.

FIG. 5 illustrates an example of the configuration of a controller for realizing the processing described above.

As shown in FIG. 5, the controller includes a CPU 100 for supervising control of the overall apparatus, and a control panel 101 for setting various parameters used in spring manufacture and applying commands for operating and stopping the apparatus. The control panel 101 has a display unit 102 for displaying the operations performed and the status of the apparatus. The CPU 100 is provided with a program memory 103 (constituted by a ROM) that stores the processing procedures of the CPU, and a RAM 104 used as a work area. The CPU 100 is connected to drivers 105~108 for various motors (all of which are servomotors), described below. The driver 105 is connected to a wire-material feed motor 109, which is the source for rotatively driving the feed rollers 3*a*, 3*b*. The driver 106 is connected to a pitch-axis motor 110, which is the source for rotatively driving the cam 30. The driver 107 is connected to a point-axis motor 111, which is for moving the point tools 4*a*, 4*b* in FIG. 1 or the point tool 21 in FIG. 2. It should be noted that the point-axis motor 111 is driven mainly in a case where a tapered spring is manufactured. The driver 108 is connected to a cutting-axis motor 112, which is for moving the cutting tool 7 along the z axis. Thus, the spring manufacturing apparatus of this embodiment is equipped with four motors.

Examples of the parameters set using the control panel 101 are items of information (spring diameter, spring pitch, free length of the spring) that specify the shape of the spring, as well as the number of springs to be manufactured, etc. The rotational speed and number of turns of each motor, as well as the positions of the point tools, are decided in dependence upon the information specifying spring shape, but these are not described here as they do not have a direct bearing upon the present invention.

In accordance with the spring manufacturing apparatus of this embodiment, as described above, the manufacture of springs by the wedge and pushing methods can be achieved by a single common drive mechanism, and the drive mechanism can be made very simple. The changeover between these two methods can be made by exchanging a small number of parts, and the operation for exchanging these parts is a simple one since it is carried out in the vicinity of the spring manufacturing area, which is exposed at the exterior of the apparatus.

Furthermore, since the wedge tool 6 is secured to the slider portion 32, the driving force produced by the turning motion of the cam 30 is supplied directly to the wedge tool essentially without the intervention of any mechanism. In a case where spring pitch is formed by the pushing tool 22, the driving force from the cam 30 is transmitted solely through a single part, namely the inclined member 40. More specifically, in comparison with the conventional mechanism in which the driving force is supplied through a large number of mechanisms, the present invention makes it possible to raise precision by a wide margin.

Thus, in accordance with the present invention, as described above, it is possible to apply pitch to springs in accordance with either the wedge method or the pushing method in a highly accurate manner and by a simple structure through use of a single driving source.

As many apparently widely different embodiments of the present invention can be made without departing from the spirit and scope thereof, it is to be understood that the invention is not limited to the specific embodiments thereof except as defined in the appended claims.

What is claimed is:

1. A spring pitch forming mechanism in a spring manufacturing apparatus having a first mode and a second mode for supplying a wire material toward a point tool through a guide in the proximity of a spring forming area and bringing the wire material into contact with the point tool to forcibly bend the wire material so as to produce a spring diameter and apply a pitch to the wire material, wherein said first mode produces a pitch between loops of the bent wire material by forcibly inserting a wedge tool, which has a sharp blade, between the bent wire material and the guide, and said second mode produces a pitch by pushing the bent wire material using a pushing tool that moves at substantially right angles to both a direction in which the wedge tool is inserted and a direction in which the wire material is supplied, said mechanism comprising:

a cam turned by a motor;

a first slider portion, one end of which is in abutting contact with a side face of said cam, for moving in a direction the same as the insertion direction of the wedge tool, said wedge tool being freely detachably mounted on said first slider portion;

a second slider portion, on which the pushing tool is mounted, for sliding in the direction in which the pushing tool moves; and a moving-direction converting member, which is freely detachably mounted on said first slider portion, for transmitting motion of said first slider portion to said second slider portion;

wherein in a case where a spring pitch is produced in said first mode, said moving-direction converting member is detached from said first slider portion and the wedge tool is mounted on said first slider portion; and in a case where a spring pitch is produced in said second mode, said moving-direction converting member is mounted on said first slider portion and the wedge tool is detached from said first slider portion.

2. The mechanism according to claim 1, wherein a projection is provided on a side face of said second slider portion, and said moving-direction converting member has a portion in abutting contact with said projection, said portion being tapered in shape.

3. The mechanism according to claim 1, further comprising:

first spring means for constantly tensioning said first slider portion in a direction opposite that in which the wedge tool is inserted; and second spring means for constantly tensioning said second slider portion is a direction opposite that in which the wire material is pushed by the pushing tool.

4. A spring pitch forming mechanism in an apparatus for manufacturing a spring by supplying a wire material toward a point tool through a guide in the proximity of a spring forming area and bringing the wire material into contact with the point tool to forcibly bend the wire material so as to produce a spring diameter, comprising:

a cam turned by a motor;

a first slider portion in abutting contact with a side face of said cam for moving in a direction substantially perpendicular to a direction in which the wire material is supplied;

a second slider portion mounting a pushing member having a distal end situated in the proximity of the spring forming area for pushing the wire material bent by the point tool in a direction substantially perpendicular to a bending plane of the wire material, said second slider portion having a prescribed projection on a side face thereof and being freely movable in the direction substantially perpendicular to the bending plane;

an inclined member freely detachably mounted on said first slider portion and having an inclined contact surface for coming into abutting contact with the projection of said second slider portion; and a wedge member freely detachably mounted on said first slider portion and having a sharp blade for being thrust between the guide and the wire material bent by the point tool;

wherein in a case where a spring pitch is formed by the pushing member, said inclined member is mounted on said first slider portion and the wedge member is detached from said first slider portion; and in a case where a spring pitch is formed by the wedge member, the wedge member is mounted on said first slider portion and the inclined member is detached from said first slider portion.

* * * * *